US008261450B1

(12) United States Patent
Cook

(10) Patent No.: US 8,261,450 B1
(45) Date of Patent: Sep. 11, 2012

(54) RAZOR AND AUXILIARY HANDLE

(76) Inventor: Dana Charles Cook, Rosharon, TX (US)

( * ) Notice: Subject to any disclaimer, the term of this patent is extended or adjusted under 35 U.S.C. 154(b) by 0 days.

(21) Appl. No.: 13/296,493

(22) Filed: Nov. 15, 2011

(51) Int. Cl.
*B26B 21/00* (2006.01)
*B26B 21/40* (2006.01)
*B26B 21/46* (2006.01)

(52) U.S. Cl. ..... 30/34.05; 30/41; 30/41.7; 30/526; 30/535; 30/537

(58) Field of Classification Search ..... 30/34.05, 30/50, 41–41.8, 526–541; 16/430; 132/289, 132/292; 411/354; D28/44–48; D8/107; 403/326, 329
See application file for complete search history.

(56) References Cited

U.S. PATENT DOCUMENTS

| | | | | | |
|---|---|---|---|---|---|
| 1,749,051 | A | * | 3/1930 | Watt | 30/526 |
| 2,429,352 | A | * | 10/1947 | Garritson | 30/535 |
| 3,486,630 | A | * | 12/1969 | Ellman | 132/289 |
| 3,878,605 | A | * | 4/1975 | Braginetz | 30/526 |
| 3,934,591 | A | * | 1/1976 | Gleason | 30/283 |
| 4,228,587 | A | * | 10/1980 | Bennett | 30/535 |
| 4,371,282 | A | * | 2/1983 | Sturm | 403/248 |
| 4,642,837 | A | * | 2/1987 | Nichols et al. | 15/176.5 |
| 4,756,640 | A | * | 7/1988 | Gehrke | 403/326 |
| 4,905,372 | A | * | 3/1990 | Willis | 30/526 |
| 5,018,543 | A | * | 5/1991 | Trillo Martinez et al. | 30/535 |
| 5,240,107 | A | | 8/1993 | Casale | |
| 5,472,250 | A | * | 12/1995 | Schlangen | 294/99.1 |
| 5,496,126 | A | * | 3/1996 | Lin | 403/370 |
| 5,579,848 | A | * | 12/1996 | Hsu | 403/314 |
| 5,600,887 | A | * | 2/1997 | Olson | 30/41.5 |
| 5,608,972 | A | * | 3/1997 | Tsae-Chyn | 30/526 |
| 5,855,066 | A | * | 1/1999 | Manger | 30/535 |
| D431,681 | S | * | 10/2000 | Seger | D28/48 |
| 6,189,222 | B1 | * | 2/2001 | Doyle | 30/531 |
| D472,673 | S | * | 4/2003 | Carvotta et al. | D28/44 |
| 6,598,609 | B2 | | 7/2003 | Gibbs | |
| D507,379 | S | * | 7/2005 | Alphonso | D28/48 |
| 6,915,580 | B2 | * | 7/2005 | Dassel | 30/526 |
| 6,986,207 | B2 | * | 1/2006 | Selek | 30/41 |
| 7,028,407 | B2 | * | 4/2006 | Ehrlich et al. | 30/526 |
| D560,032 | S | * | 1/2008 | Lopez | D28/48 |
| 7,726,032 | B1 | * | 6/2010 | Hernandez | 30/526 |
| D621,544 | S | * | 8/2010 | Bommarito | D28/48 |
| 7,805,846 | B2 | | 10/2010 | Leventhal et al. | |

(Continued)

FOREIGN PATENT DOCUMENTS

DE 102004033697 A1 * 2/2006

(Continued)

*Primary Examiner* — Jason Daniel Prone
(74) *Attorney, Agent, or Firm* — Dale J. Ream

(57) ABSTRACT

A handle and stand apparatus for holding a razor in an upright configuration includes a housing defining an interior area and an open top and bottom. A plurality of gripping members extends upwardly in the interior area and each includes a distal end adjacent the open top. A clamping member is situated in the open top of the housing defining a bore configured to receive the handle of the razor into the interior area. The clamping member is rotatable between a clamped configuration in which the gripping members are urged inwardly about the razor handle and a released configuration in which the gripping members are released away from the razor handle. A vibration device may be situated in the housing interior area to cause water droplets to be dislodged from the razor when energized. The apparatus may include a counter circuit and display to monitor a number of razor uses.

16 Claims, 6 Drawing Sheets

U.S. PATENT DOCUMENTS

| | | | | |
|---|---|---|---|---|
| 7,810,243 | B2 | 10/2010 | Schnak et al. | |
| 7,814,661 | B2 * | 10/2010 | Tomassetti | 30/535 |
| 8,006,393 | B2 * | 8/2011 | Collins | 30/526 |
| 2003/0177648 | A1 * | 9/2003 | Zeiter | 30/526 |
| 2004/0107585 | A1 * | 6/2004 | Helmrich | 30/537 |
| 2008/0052912 | A1 * | 3/2008 | Barry et al. | 30/41.7 |
| 2011/0094114 | A1 * | 4/2011 | Payne-Baggetta | 30/526 |
| 2011/0314677 | A1 * | 12/2011 | Meier et al. | 30/41.8 |

FOREIGN PATENT DOCUMENTS

| | | | |
|---|---|---|---|
| EP | 0252187 | A2 * | 1/1988 |
| GB | 1180220 | A * | 2/1970 |
| GB | 1404735 | A * | 9/1975 |
| GB | 2254104 | A * | 9/1992 |

* cited by examiner

RAZOR AND AUXILIARY HANDLE

BACKGROUND OF THE INVENTION

This invention relates generally to safety razor accessory products and, more particularly, to an auxiliary razor handle and stand apparatus for holding a safety razor in an upright configuration so as to drain water more effectively.

Safety razors are commonly used by men to shave their faces daily and by women to shave their legs regularly. Although these razors generally work effectively, the respective razor blades never seem to last very long and, as a result, must be changed frequently. One reason why steel razor blades degrade in sharpness and overall integrity is because of water that remains on the blades after use. In fact, a razor blade may still have water droplets on it when it is used the next day. The longer water remains on the blade is indicative of an increased amount or speed of blade degradation.

Various devices have been proposed in the art for providing razor handles having a—powered functionality (U.S. Pat. No. 7,810,243), a retractable blade assembly (U.S. Pat. No. 7,805,846), portable holders of shaving instrumentation (U.S. Pat. No. 6,598,609), and a holder with shave counter (U.S. Pat. No. 5,240,107). Although assumably effective for their intended use, the existing devices do not provide one or more means for decreasing the amount of residual water on a razor blade after use in shaving or for increasing the speed with which a razor blade dries. The existing products and proposals also do not provide a device that is both an auxiliary handle for using a safety razor and also an upstanding stand for holding a safety razor in a vertical orientation for enhanced water removal. In addition, the existing products do not aid a user in keeping track of how many times the razor has been used.

Therefore, it would be desirable to have an auxiliary razor handle and stand apparatus into which a razor handle is received and which stores the safety razor in a vertical orientation when not in use. Further, it would be desirable to have an auxiliary razor handle and stand apparatus that selectively secures the handle so that the apparatus may be used as an auxiliary handle during use. In addition, it would be desirable to have an auxiliary razor handle and stand apparatus that includes a vibration device to enhance removing water from the razor and includes a counter circuit and digital display device to show a user how many times the razor has been used.

SUMMARY OF THE INVENTION

An auxiliary handle and stand apparatus for holding a safety razor in an upright configuration when not in use includes a lower housing having a continuous side wall defining a lower housing interior area and an upper housing having a continuous side wall defining an upper housing interior area. A plurality of gripping members extend upwardly from the lower housing into the upper housing interior area, each gripping member being resilient having a normally outwardly biased configuration. Each gripping member includes a distal end adjacent the upper housing open top. A clamping member is situated in the open top of the upper housing defining a bore configured to receive the handle of the razor into the upper housing interior area. The clamping member is rotatably movable between a clamped configuration in which the plurality of gripping members are urged inwardly about the razor handle when received in the upper housing interior area and a released configuration in which the plurality of gripping members are released to the normally outwardly biased configuration away from the razor handle. The gripping members secure the razor handle when the clamping member is at the clamping configuration.

The apparatus may also include a vibration device positioned to cause water droplets to be dislodged from the razor handle when energized, thus prolonging usefulness of the razor blade. The apparatus may also include a counter circuit and display to keep track of how many times the safety razor has been used. Still further, the apparatus 10 may include a fluid reservoir that emits shaving cream when actuated.

Therefore, a general object of this invention is to provide a razor and stand apparatus for holding a safety razor in an upright configuration when not in use.

Another object of this invention is to provide a razor and stand apparatus, as aforesaid, having a clamping device for selectively clamping or releasing the handle of a safety razor within an interior area of a housing.

Still another object of this invention is to provide a razor and stand apparatus, as aforesaid, having a vibration device situated proximate to a razor handle and configured to cause water droplets to be dislodged quickly and thoroughly from a razor blade after use.

Yet another object of this invention is to provide a razor and stand apparatus, as aforesaid, having a digital counter circuit and display configured to increment a count representing the number of times the razor has been used and to display that count to a user.

A further object of this invention is to provide a razor and stand apparatus, as aforesaid, that includes a fluid reservoir configured to deliver a fluid through an outlet port when actuated.

A still further object of this invention is to provide a razor and stand apparatus, as aforesaid, that is easy to use and cost-effective to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
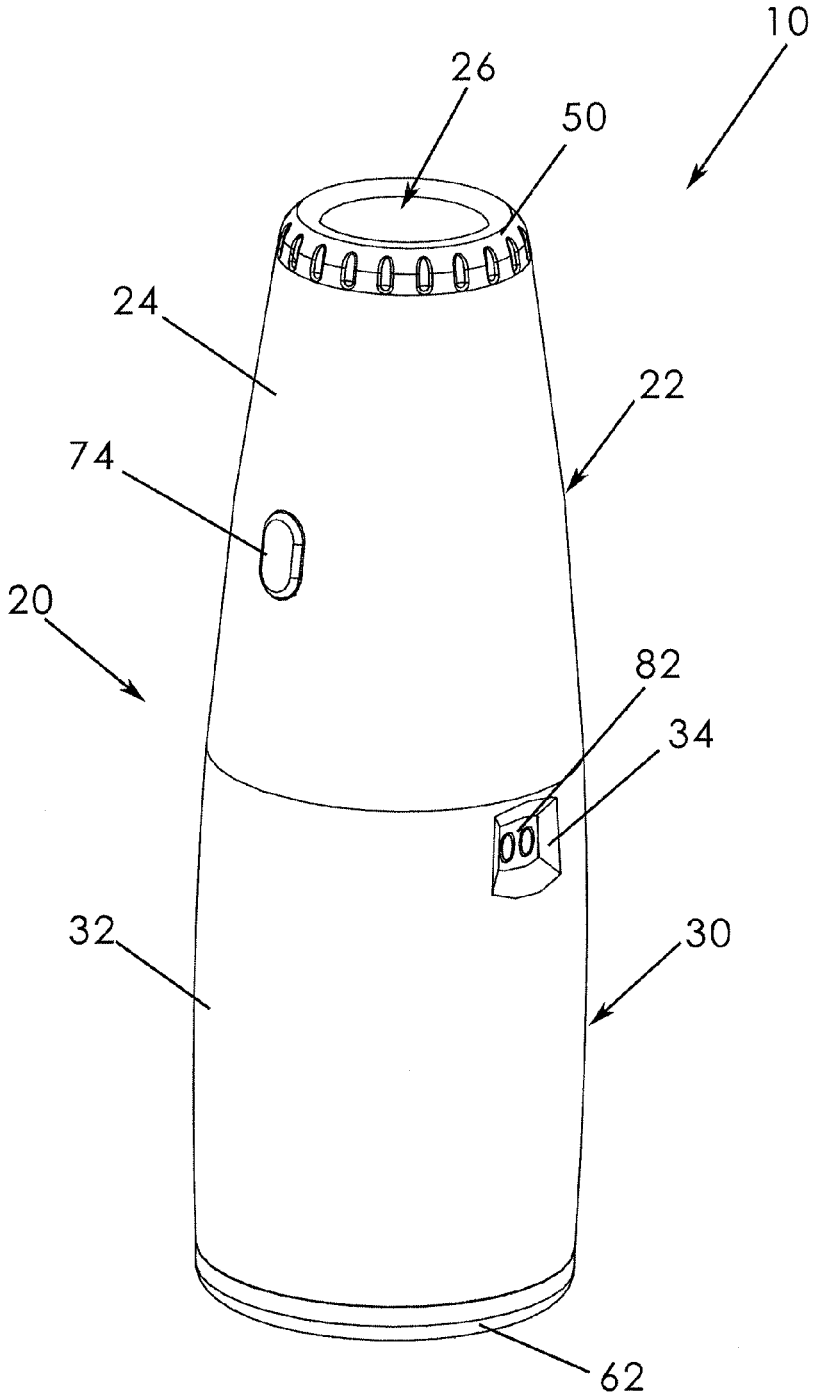
FIG. 1 is a perspective view of a razor handle and stand apparatus according to a preferred embodiment of the present invention.

A razor auxiliary handle and stand apparatus according to a preferred embodiment of the present invention will now be described with reference to FIGS. 1 to 6 of the accompanying drawings. The razor auxiliary handle and stand apparatus 10 includes a housing 20 having an open top 26 configured to receive the handle 8 of a safety razor therein and a clamping member 50 configured to selectively secure the razor handle 8 in the housing 20 or release the razor handle 8. The apparatus 10 further includes a vibration device 70, a digital count circuit 80, and a fluid reservoir 60 as will be described below in greater detail.

Preferably, the housing 20 includes an upper housing 22 situated atop a lower housing 30 although a housing having a singular construction may also be suitable. The lower housing 30 may include a continuous side wall 32 having a generally cylindrical configuration and defining a lower housing interior area. The lower housing 30 includes upper and lower edges defining a lower housing open top and open bottom, respectively.

Similarly, the upper housing 22 may include a continuous side wall 24 having a generally cylindrical configuration and defining an upper housing interior area. The upper housing 22 includes upper and lower edges defining an upper housing open top 26 and open bottom, respectively.

Figure 5:
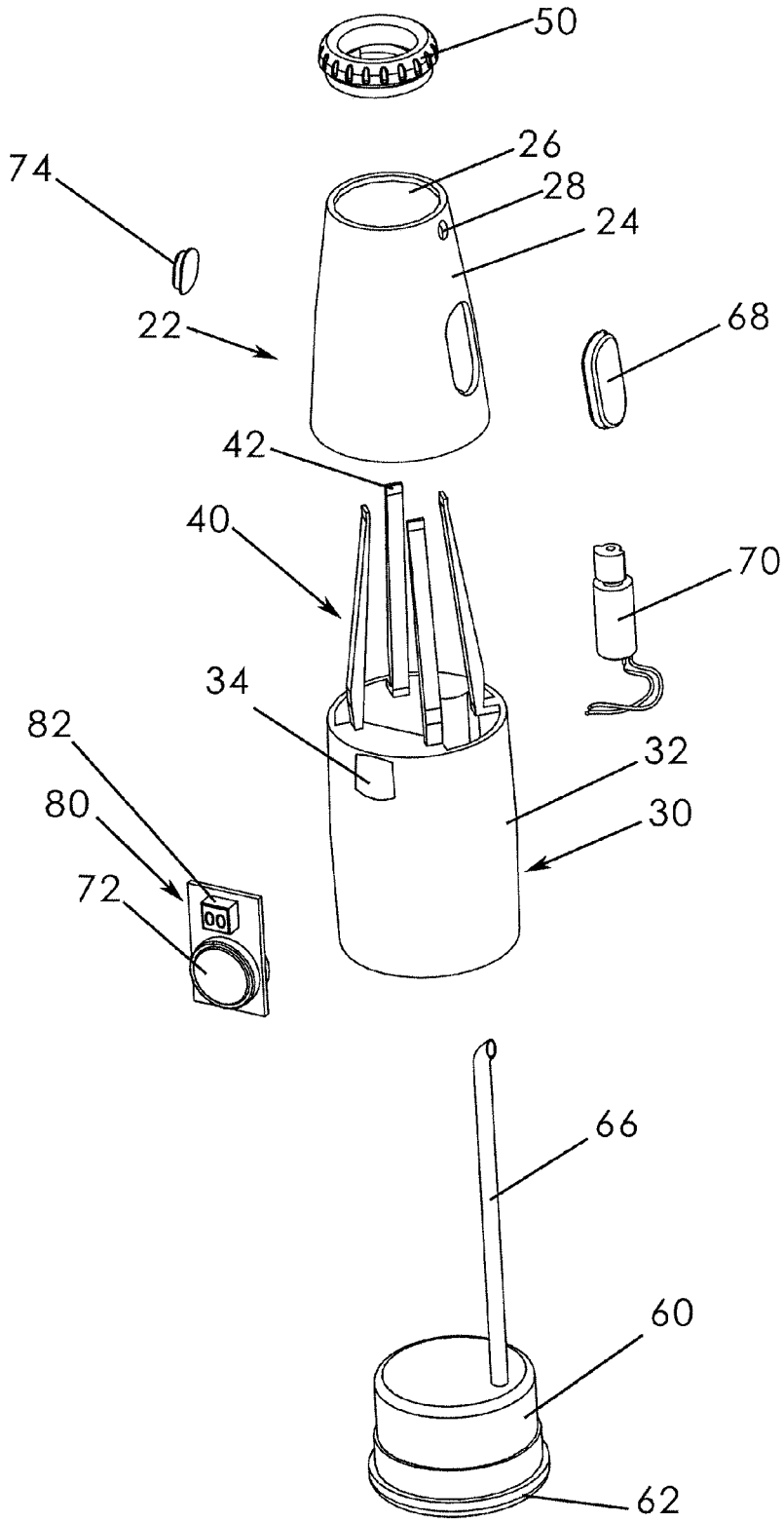
FIG. 5 is an exploded view of the razor handle and stand apparatus as in FIG. 1.
Figure 6:
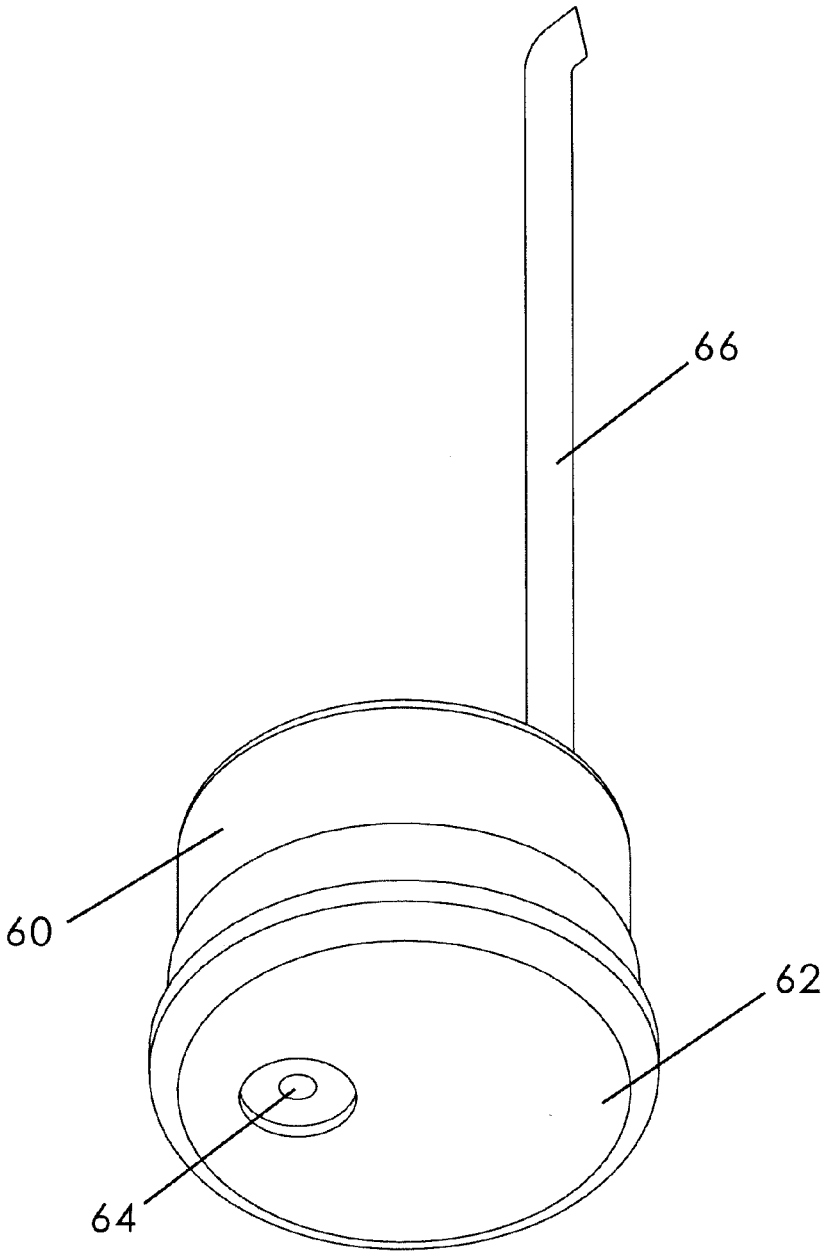
FIG. 6 is a perspective view from a bottom angle of the reservoir and tubular channel taken from FIG. 5.

A plurality of gripping members 40 extends upwardly from the upper edge of the lower housing 30 and extend into the upper housing interior area (FIG. 5). Each gripping member 40 may be spaced apart from adjacent gripping members 40. In some embodiments, each gripping member 40 includes a distal end 42 adjacent the upper housing open top 26. Each gripping member 40 includes a resilient construction having a normally outwardly biased configuration. In other words, the distal end 42 of respective gripping members 40 are normally urged toward the interior surface of the upper housing side wall 24. The gripping members 40 may be constructed of spring steel or a resilient plastic material. In addition, the distal end 42 of each gripping member 40 may include a rubber or other grip enhancing material configured to hold a safety razor handle 8 from slipping as will be described in more detail later.

A clamping member 50 is positioned atop the upper housing open top 26, the clamping member 50 defining a bore therethrough that is sized such that the handle 8 of a safety razor may be inserted through the bore and into the upper housing interior area. It is understood that the plurality of gripping members 40 is situated within the upper housing interior area, the gripping members 40 being spaced apart in a generally circular pattern such that the razor handle 8 is received within the circular pattern when inserted into the upper housing 22. The clamping member 50 is coupled to the upper housing 22 and configured to rotate between a clamped configuration in which the plurality of gripping members 40 are urged inwardly against the razor handle 8 when inserted into the upper housing 22 and a released configuration in which the plurality of gripping members 40 are allowed to return to the normally outwardly biased configuration. It is understood that a razor handle 8 is released when the gripping members 40 are at the outwardly biased configuration.

Figure 4:
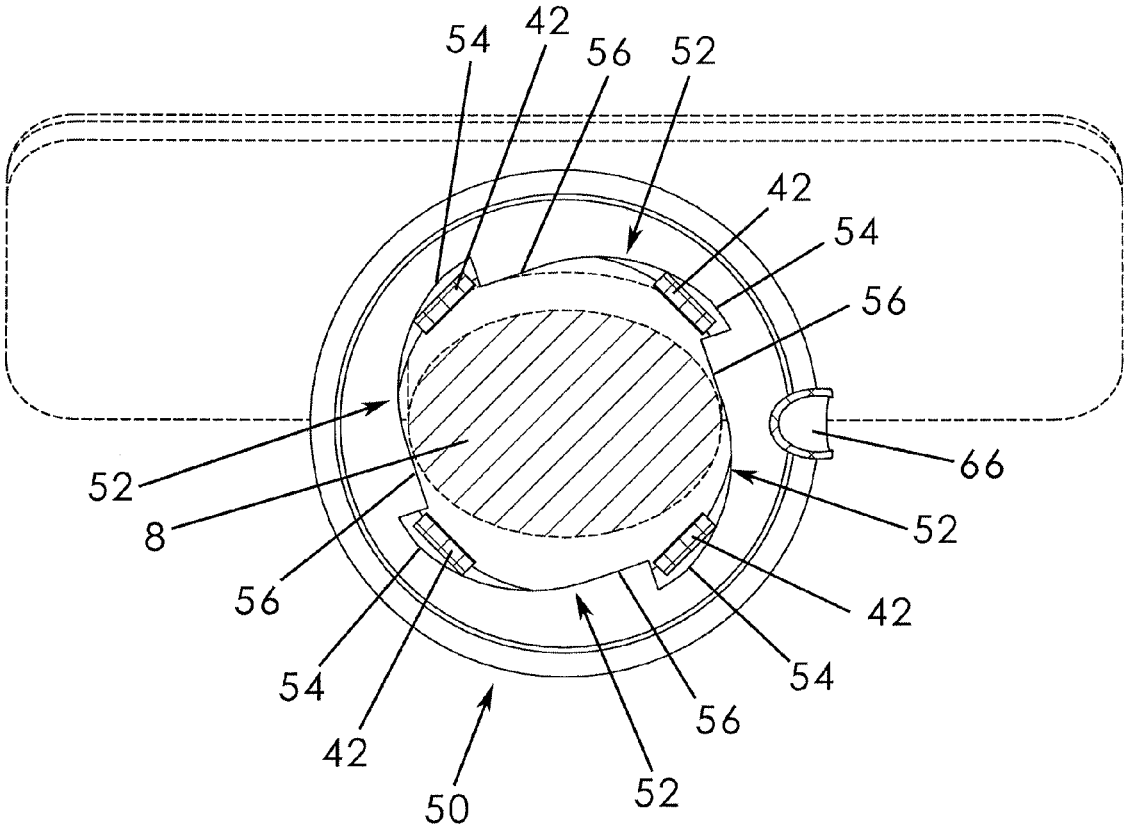
FIG. 4 is a sectional view taken along line 4-4 of FIG. 3.

With specific reference to FIG. 4, the clamping member 50 includes a plurality of spaced apart ramp sections 52, each ramp section 52 configured to receive a respective gripping member distal end 42. Further, each ramp section 52 includes at least one outer section 54 configured to receive a respective gripping member 40 at the outwardly biased configuration and at least one inner section 56 configured to urge a respective gripping member 40 inwardly. Each ramp section 52 transitions gradually between a respective outer section 54 and a respective inner section 56. In operation, each gripping member 40 is urged inwardly when the clamping member 50 is rotated from the released configuration to the clamping configuration. Respective gripping members 40 are urged inwardly until they bear firmly against a razor handle 8 so as to secure the handle 8 against unintended movement.

Figure 2:
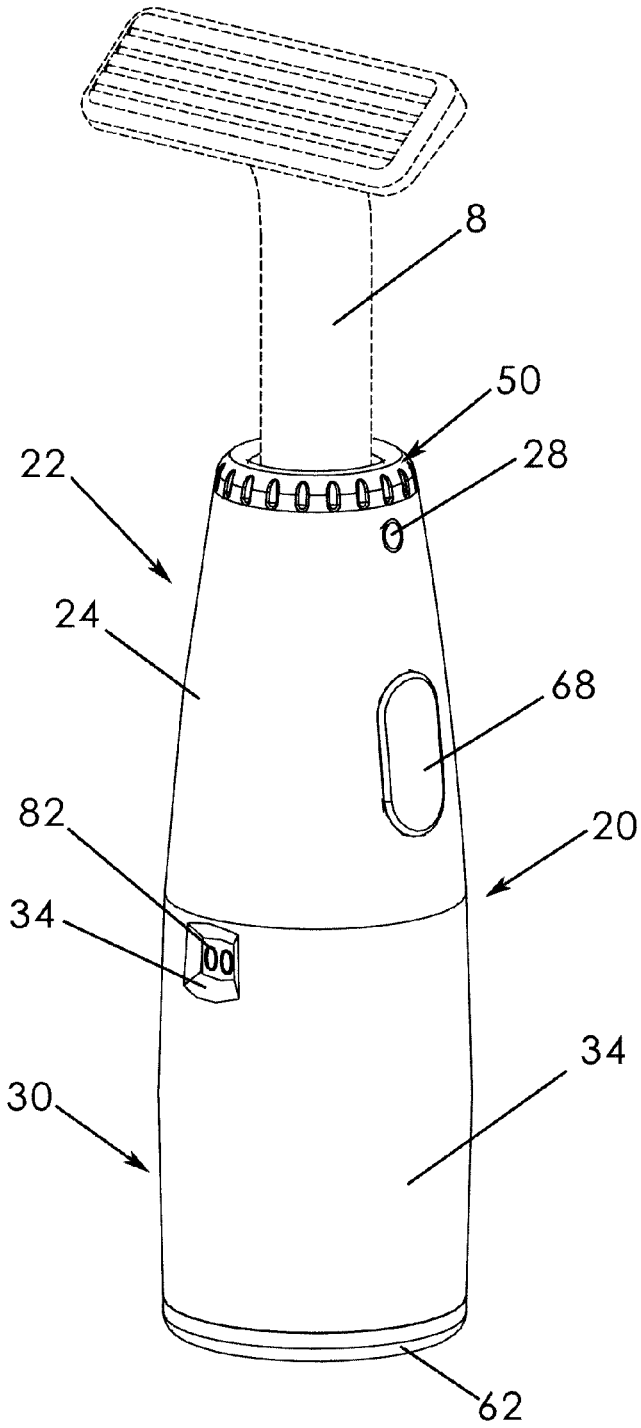
FIG. 2 is a perspective view of the razor handle and stand apparatus as in FIG. 1 in use with a safety razor.
Figure 3:
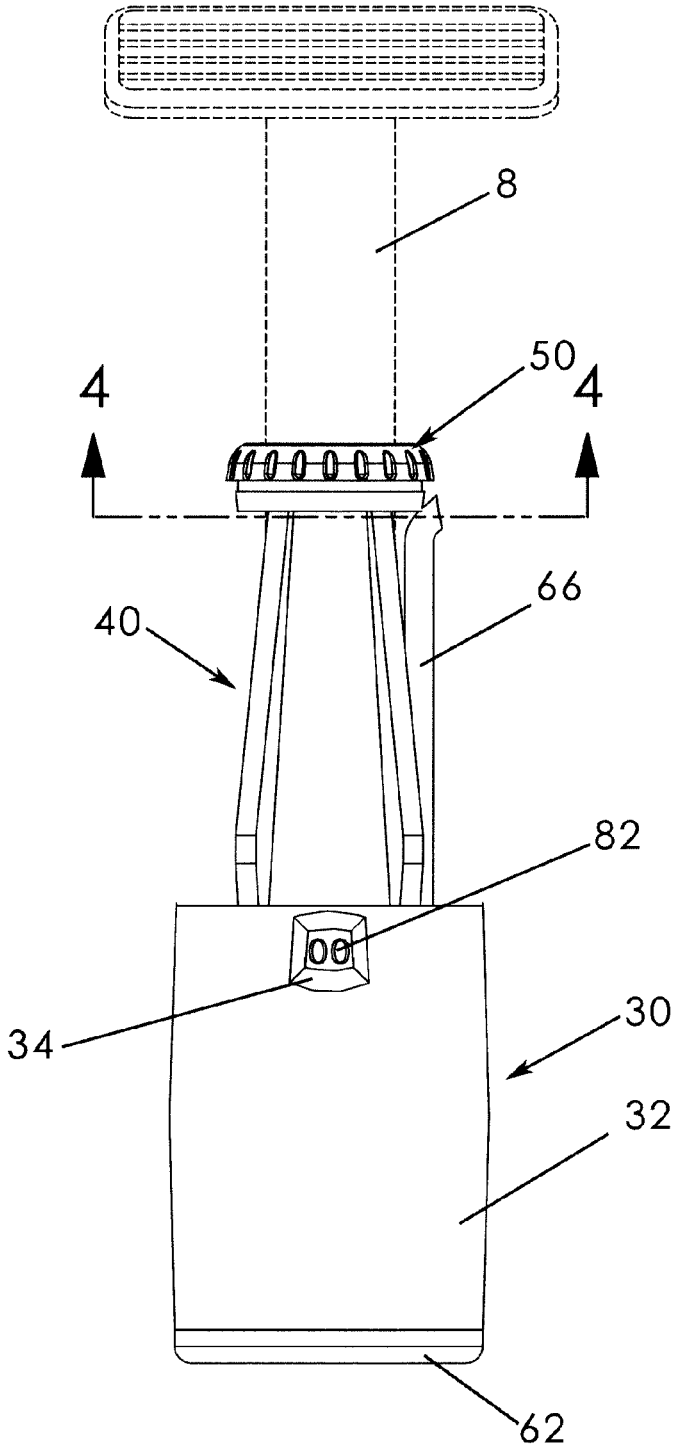
FIG. 3 is a side view of the razor handle and stand apparatus as in FIG. 2 with the upper housing removed.

The upper housing 22 defines an outlet port 28 (FIG. 2). The outlet port 28 may be in the form of a spray nozzle. In some embodiments, the fluid reservoir 60 is positioned in the lower housing 30, the reservoir 60 having a generally planar bottom surface 62 that closes the open bottom of the lower housing 30. In addition, the bottom surface 62 enables the entire housing to be positioned on a support surface (not shown) in an upright configuration. The reservoir 60 is configured to contain a fluid such as shaving cream under pressure. The reservoir 60 may include in inlet port 64 through the planar bottom surface 62 through which replacement or additional quantities of fluid may be inserted into the reservoir 60.

A tubular channel 66 is in fluid communication with the reservoir 60 and extends between the reservoir 60 and the outlet port 28. More particularly, a lower end of the tubular channel 66 includes an open end in communication with the reservoir 60 and an upper end defining an opening in communication with the outlet port 28 so that fluid from the reservoir 60 is projected outwardly from the outlet port 28 when the reservoir is actuated.

A first actuator 68 may be positioned on the side wall 24 of the upper housing 22. The first actuator 68 may be a button, knob, switch, keypad, touch screen, or the like. The first actuator 68 may be operatively coupled to the reservoir 60 such that operation thereof causes a predetermined amount of fluid to be released into the tubular channel 66. It is understood that the first actuator 68 may be coupled to a valve (not shown) that regulates passage of fluid from the reservoir 60 into the channel 66 and operation of the first actuator 68 may open the valve to allow fluid under pressure to pass into the channel 66.

In another aspect of the invention, the apparatus 10 may include a vibration device 70 situated in the lower housing interior area and positioned so as to bear against the razor handle 8 when the handle 8 is inserted into the housing 20. It is understood that the vibration device 70 may alternatively be positioned in the upper housing 22 in some embodiments although interference with the gripping members 40 is a concern. A battery 72 is also positioned in the lower housing 30 and is electrically connected to the vibration device 70 for energizing it. A second actuator 74 is positioned on the upper housing side wall 24 although other locations would also work. The second actuator 74 may be a button, knob, switch, keypad, touch screen, or the like. Preferably, the second actuator 74 is separated from the first actuator 68—such as on opposed sides of the upper housing side wall 24—so as to avoid a user unintentionally operating one or the other. The second actuator 74 may be operatively connected to the vibration device 70 and battery 72 so that the battery 72 is able to energize the vibration device 70 when the second actuator 74 is operated by a user.

The second actuator 74 may be electrically connected to the vibration device 70 with wiring or circuitry that is configured such that the vibration device 70 is energized for a predetermined amount of time when the second actuator 74 is operated. For instance, the vibration device 70 may be configured to be energized for five seconds when the second actuator 74 is operated. Of course, the components may alternatively be configured such that the vibration device 70 is activated for other predetermined amounts of time—the purpose, of course, being to dislodge water droplets from the razor that may cause the metal razor blade to degrade more quickly.

Further, the razor auxiliary handle and stand apparatus 10 may include a counter circuit 80 configured to keep a numeric count of how many times the apparatus 10 has been used. Practically, the counter circuit 80 is a way for a user to keep track of how many times a razor blade has been used so that it may be changed after an appropriate number of uses. The counter circuit 80 is electrically connected with the battery 72 (or another battery) and electrically connected to the second actuator 74 such that the counter circuit 80 is energized to increment the count upon operation of the second actuator 74. The counter circuit 80 may also include a means for resetting the count, such as when the razor is changed. This may include a reset button (not shown).

The user, of course, has a need to be informed of the numeric value being incremented and kept by the counter circuit 80. Therefore, the apparatus 10 also includes a display device 82 electrically connected to the counter circuit 80 and is configured to display the current count. Preferably, the lower housing 30 defines an aperture 34 and the display device 82 may be positioned in the lower housing interior area so as to be visible through the aperture 34. In addition, a magnification lens may be positioned in the aperture 34 such that the size of a numeral displayed by the display device 82 is enlarged.

The housing 20, including the lower housing 30 and the upper housing 22, includes an outer configuration having ergonomic characteristics. Specifically, the housing 20 may include a wider lower end diameter than upper diameter so as to be optimal for a user to hold during use. In other words, the apparatus 10 is intended to hold securely the handle of a safety razor during use and not just after use.

In use, the handle 8 of virtually any brand of safety razor may be inserted through the bore of the clamping member 50 and into the upper housing interior area. The handle 8 will also presumably extend into the lower housing interior area and bear against the vibration device 70 that is strategically positioned therein. The clamping member 50 may then be rotated from the release configuration to the clamping configuration such that the gripping members 40 are urged inwardly to tighten about the handle 8. The first actuator 68 may be operated and, in so doing, the reservoir 60 is caused to release a quantity of fluid, such as shaving cream, through the outlet port 28 into a user's hand. Holding the housing 20, the razor may be used to shave a user's face. When finished, the housing 20 may be placed in a vertical orientation resting on the bottom surface 62 of the reservoir 60. The second actuator 74 may then be operated in order to cause the vibration device 70 to be energized for a predetermined amount of time, say, five seconds. Operation of the vibration device 70 causes water droplets to be dislodged from and to drain from the razor so as to lengthen the useful life of the blade as discussed above. Operation of the second actuator 74 also causes the counter circuit 80 to increment the count. The current count—which correlates to a number of uses of the razor blade—is then automatically displayed on the display device 82. If the user desires to remove the safety razor, the clamping member 50 may be reversibly rotated to the release configuration to enable the gripping members to return to the normally outwardly biased configuration and the safety razor removed.

It is understood that while certain forms of this invention have been illustrated and described, it is not limited thereto except insofar as such limitations are included in the following claims and allowable functional equivalents thereof.

The invention claimed is:

1. An assembly comprising a razor having a handle and an auxiliary handle; wherein said auxiliary handle further comprises:

a lower housing having a continuous side wall defining a lower housing interior area;

an upper housing having a continuous side wall defining an upper housing interior area, said upper housing side wall having a lower edge coupled to an upper edge of said lower housing side wall and said upper housing defining an open bottom and an open top;

a plurality of gripping members extending upwardly from said lower housing into said upper housing interior area, each of said gripping member being resilient having a normally outwardly biased configuration;

wherein each of said gripping member includes a distal end adjacent said upper housing open top; and a clamping member situated in said open top of said upper housing defining a bore therethrough configured to receive the handle of the razor therethrough into said upper housing interior area, said clamping member being coupled to said upper housing and configured to rotate between a clamped configuration in which said plurality of gripping members are urged inwardly about the razor handle when received in said upper housing interior area and a released configuration in which said plurality of gripping members are released to said normally outwardly biased configuration away from the razor handle.

2. The assembly as in claim 1 wherein the auxiliary handle further comprises said upper housing defining an outlet port;

a reservoir positioned in said lower housing interior area configured to contain a fluid; and a tubular channel in fluid communication with said reservoir and extending upwardly through said lower housing, said tubular channel configured to project said fluid outwardly through said outlet port when said reservoir is actuated.

3. The assembly as in claim 2, wherein said tubular channel includes a lower end defining an opening in communication with said reservoir and an upper end defining an opening in communication with said outlet port.

4. The assembly as in claim 2, wherein the auxiliary handle further comprises a first actuator situated on said upper housing in operative communication with said reservoir, said first actuator configured such that operation thereof causes fluid contained in said reservoir to flow through said tubular channel.

5. The assembly as in claim 2, wherein said reservoir includes an inlet port configured to selectively receive a refill of fluid into said reservoir.

6. The assembly as in claim 5, wherein said reservoir includes a bottom surface having a generally planar configuration.

7. The assembly as in claim 6, wherein said inlet port is in said bottom surface of said reservoir.

8. The assembly as in claim 1, wherein the auxiliary handle further comprises:

a vibration device positioned in said lower housing interior area so as to bear against the razor handle when inserted into said upper housing interior area; and a battery electrically connected to said vibration device; and a second actuator on said upper housing electrically connected to said vibration device and configured to cause current to be delivered to said vibration device when operated.

9. The assembly as in claim 8, wherein said vibration device is configured to operate for a predetermined amount of time when energized.

10. The assembly as in claim 9, wherein said predetermined time is five seconds.

11. The assembly as in claim 8, wherein the auxiliary handle further comprises a counter circuit in electrical communication with said battery and said second actuator, said counter circuit configured to increment a count when energized upon operation of said second actuator.

12. The assembly as in claim 11, wherein the auxiliary handle further comprises a display device electrically connected to said counter circuit and configured to display said count.

13. The assembly as in claim 12, wherein:

said lower housing side wall defines an aperture; and said display device is positioned in said lower housing interior area so as to be visible through said aperture.

14. The assembly as in claim 13, wherein the auxiliary handle further comprises a magnification lens situated in said aperture so that a size of said count displayed by said display device is magnified.

15. The assembly as in claim 1, wherein outer portions of each of said side walls are ergonomic.

16. The assembly as in claim 1, wherein said clamping member includes a plurality of ramp sections, wherein each of the ramp sections includes an outer section configured to receive a respective one of said gripping member distal ends at said normally outwardly biased configuration and an inner section configured to urge said respective one of said gripping member distal ends inwardly when said clamping member is rotated, and wherein each of the ramp sections is sloped gradually between the outer section to the inner section.

* * * * *